United States Patent [19]

Kraus

[11] Patent Number: 4,866,439

[45] Date of Patent: Sep. 12, 1989

[54] EXPLOSIVES DETECTION SYSTEM FOR AN AIRCRAFT

[76] Inventor: John H. Kraus, 600 Calle Chayote, San Clemente, Calif. 92672

[21] Appl. No.: 31,394

[22] Filed: Mar. 27, 1987

[51] Int. Cl.[4] ..... G08B 21/00; G08B 17/10

[52] U.S. Cl. ..... 340/945; 244/1 R; 340/632; 422/96

[58] Field of Search ..... 340/945, 963, 632, 633; 364/424; 422/94–96, 98; 73/23, 167; 244/1 R; 358/108, 110; 299/12; 102/93

[56] References Cited

U.S. PATENT DOCUMENTS

| | | | |
|---|---|---|---|
| 1,088,611 | 2/1914 | Neubauer . | |
| 2,441,677 | 4/1945 | Stallsmith et al. . | |
| 3,255,352 | 6/1966 | Johnston | 340/541 |
| 3,553,461 | 1/1971 | Siano et al. | 340/633 |
| 3,711,638 | 1/1973 | Davies | 244/1 R |
| 4,045,997 | 9/1977 | Showalter et al. | 340/632 |
| 4,258,002 | 3/1981 | Barr | 422/95 |
| 4,263,588 | 4/1981 | Gautier | 340/632 |
| 4,317,796 | 3/1982 | Barr | 422/95 |
| 4,352,099 | 9/1982 | Christen et al. | 422/96 |
| 4,480,252 | 10/1984 | Buonavita . | |
| 4,514,691 | 4/1985 | De Los Santos et al. | 73/61 R |
| 4,517,161 | 5/1985 | Gravina et al. . | |
| 4,670,405 | 6/1987 | Stetter et al. | 422/98 |

FOREIGN PATENT DOCUMENTS

| | | | |
|---|---|---|---|
| 0002490 | 1/1977 | Japan | 340/632 |

OTHER PUBLICATIONS

Department of the Treasury, Bureau of Alcohol, Tabacco and Firearms, "Bomb Threats and Search Techniques", Apr. 1975, pp. 12–13.

Product Sheets of GC-710 and GC-712 explosives eetectors manufactured by XonTech, Inc. of Van Nuys, Calif.

Product Sheets of Models 35, 55, 97 and Entry Scan Mark II explosives detection equipment manufactured by ITI Security of Burlington, Mass.

Sullivan/Watson, "Sampling of Explosives with Multiple, Portable Preconcentrating Cartridges".

Harvey J. McGeorge, II, "Kinetics of Terrorism", Summer 1983, pp. 37–38.

Thomas G. Brodie, "Principles of Bomb Protection", Summer 1986.

Wayne Biddle, "It Must Be Simple and Reliable", Jun. 1986.

*Primary Examiner*—Joseph A. Orsino

*Assistant Examiner*—Brent A. Swarthout

*Attorney, Agent, or Firm*—Knobbe, Martens, Olson & Bear

[57] ABSTRACT

An explosives detection system for an aircraft to deter terrorist activity in which a plurality of explosives detectors are located about the interior passenger compartment of the aircraft in order to detect the presence of explosives. The explosives detectors generate an electronic signal upon sensing explosives and are periodically sampled so that an appropriate alarm signal may be generated upon the detection of explosives. The alarm signal causes a pair of cameras to be directed towards the vicinity in which explosives were detected and may also automatically shut down the aircraft.

22 Claims, 3 Drawing Sheets

Fig. 1
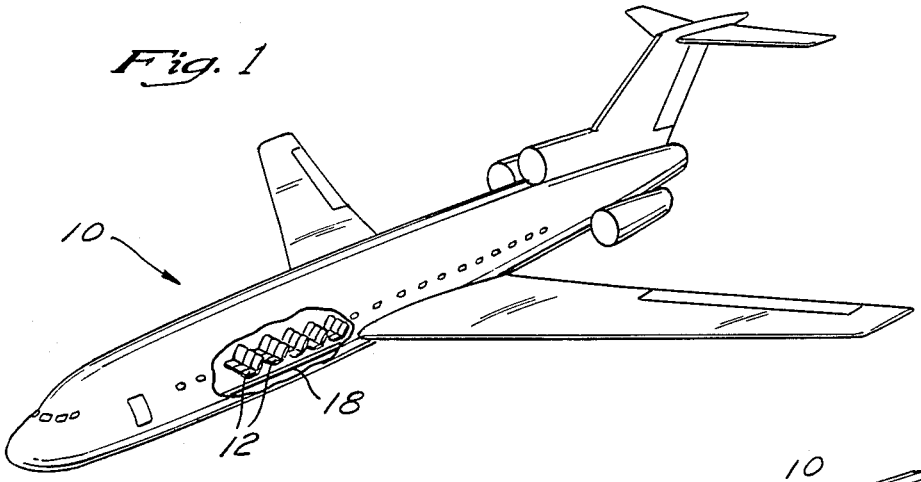
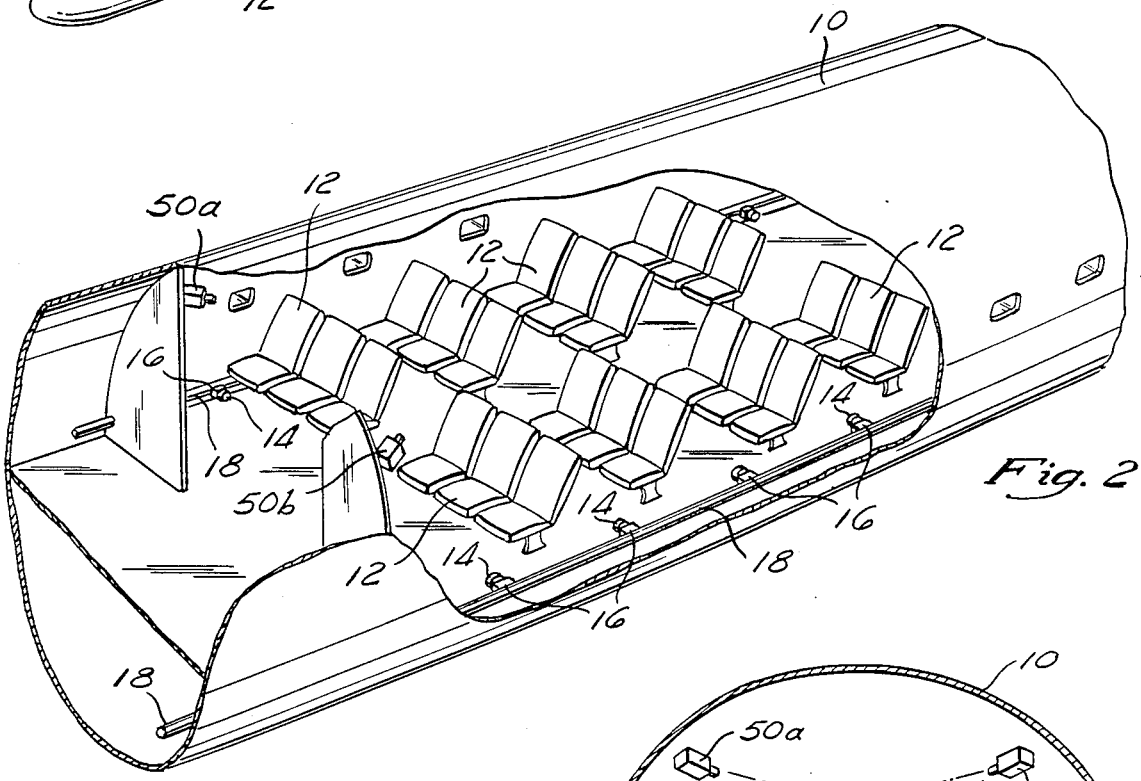
Fig. 2
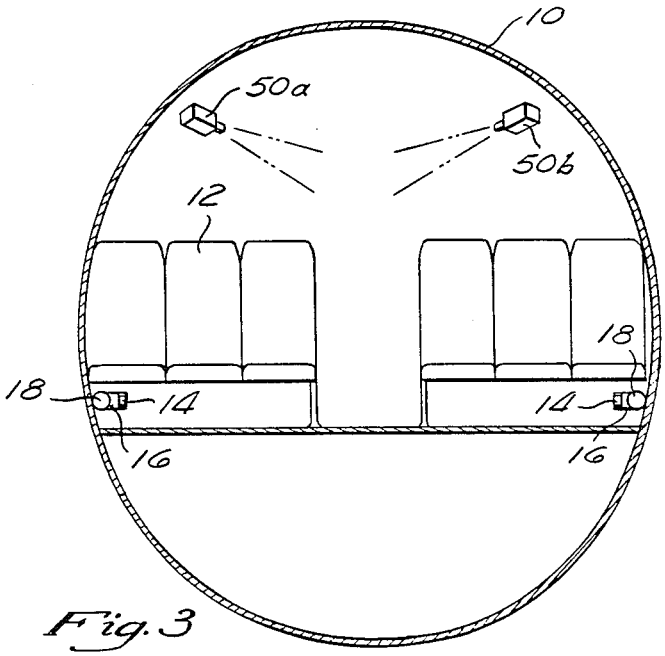
Fig. 3
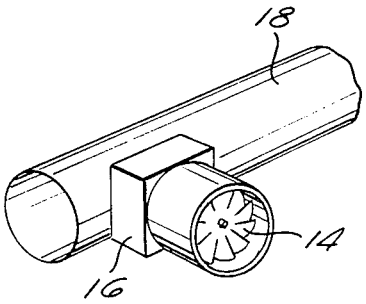
Fig. 4

EXPLOSIVES DETECTION SYSTEM FOR AN AIRCRAFT

BACKGROUND OF THE INVENTION

The present invention is directed towards an explosives detection system for an aircraft, and more particularly to an explosives detection system which continuously tests the internal passenger compartment of an aircraft for the presence of gases which are emitted from explosives such as dynamite, TNT, plastic explosives, and the like.

An exceedingly dangerous and growing problem in air travel is terrorist activity. All too often, such terrorists smuggle bombs on board commercial airliners and threaten to explode them unless the terrorists' demands are met. This criminal activity endangers the lives of the passengers on board the aircraft and sometimes results in loss of life. A number of attempts have been made to prevent this criminal activity and its abhorrent effects. Dogs have been specially trained to identify and sniff for the presence of explosives and, in a number of cases, have been successful in preventing terrorists with explosives from boarding a plane. Specially-designed explosives detectors which are commercially available can detect the presence of explosives. These explosives detectors are akin to metal detectors, which are now almost universally used in airports to prevent terrorists from smuggling guns on board aircraft. One disadvantage inherent in these commercially available explosives detectors is that, unlike metal detectors, they are not capable of detecting the presence of explosives substantially instantaneously. Instead, such explosive detectors may require at least five to ten seconds to detect the presence of explosives, and may take up to a minute or longer if the explosives are hermetically sealed. As a result, the use of such explosives detectors would create greater delays prior to aircraft boarding than are now caused by the use of metal detectors.

Another disadvantage inherent in the use of specially-trained dogs and explosives detectors is that security may vary widely from airport to airport, especially in European countries and the Middle East. Thus, even if a flight originates in an airport which utilizes guard dogs and/or explosives detectors, the passengers are put at risk if the flight boards additional passengers at an airport with lax security measures.

SUMMARY OF THE INVENTION

These and other disadvantages are eliminated by the present invention, which provides an explosives detection system on board an aircraft which has a plurality of explosives detectors to sample the environment of the interior passenger compartment of the aircraft to detect the presence of explosives. The detection system includes an electronic circuit connected to the explosives detectors which provides an electronic signal which indicates the presence of explosives on board the aircraft upon one of the explosives detectors sensing the presence of explosives.

In another aspect, the invention is directed towards a detection system which also includes a plurality of air fans positioned to cause air to be directed towards the explosives detectors and includes an electronic circuit connected to the explosives detectors to provide a first electronic signal which preliminarily indicates the presence of explosives on board the aircraft. This electronic signal also causes the rotational speed of the fans to be increased in order to provide an increased air flow to the explosives detectors. The electronic circuit also provides a second electronic signal which confirms the presence of explosives on board the aircraft.

In a further aspect, the invention is directed towards an explosives detection system which includes an electronic circuit which periodically samples the outputs of the explosives detectors on a multiplexed basis.

In still another aspect, the invention is directed towards an explosives detection system which includes an electronic circuit connected to the explosives detectors which provides a first electronic signal upon the output of one of the explosives detectors satisfying a first predetermined threshold and a second electronic signal upon the output of the explosives detector satisfying a second predetermined threshold.

These and other features and advantages of the invention will be apparent in view of the following detailed description of several preferred embodiments, which are explained with reference to the figures, a brief description of which is provided below.

BRIEF DESCRIPTION OF THE DRAWINGS

FIG. 1 is a perspective view of a commercial aircraft with a portion, of the aircraft removed to show the interior passenger compartment;

FIG. 2 is an enlarged view of the interior passenger compartment, of the aircraft shown in FIG. 1;

FIG. 3 is a cross-sectional view of the commercial aircraft of FIG. 1 showing two rows of seats;

FIG. 4 is a perspective view of a fan, an explosives detector, and an exhaust pipe of one embodiment of an explosives detection system for the aircraft of FIG. 1;

DETAILED DESCRIPTION OF SEVERAL PREFERRED EMBODIMENTS

Figure 5:
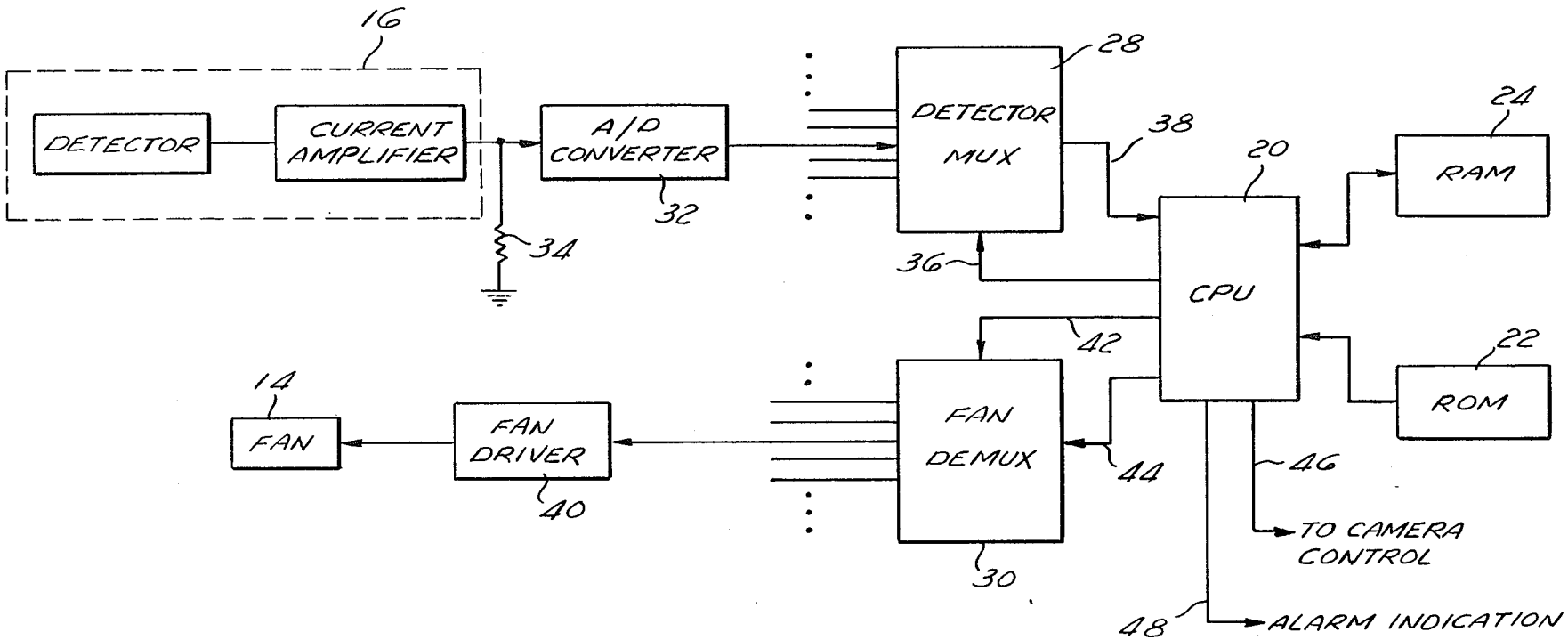
FIG. 5 is a schematic view of the electronics of an explosives detection system for an aircraft.

The cabin portion of a commercial aircraft 10 is illustrated in FIG. 2. Eight rows of seats 12 are shown, each row comprising three seats 12 with a space in the middle to accommodate the center aisle of the aircraft. Adjacent an end of each row of seats is an air fan 14 fluidly coupled to an explosives detector 16. The explosives detectors 16 are located close to the floor in the general area in which a passenger's feet would lie. Each of the explosives detectors 16 is connected to an exhaust pipe 18 which runs the length of the passenger compartment on either side of the aircraft 10. As will be explained in more detail below, substantially the entire interior environment of the passenger compartment is tested for the presence of explosives by drawing air into the explosives detectors 16 with the aid of the air fans 14, passing the air through the explosives detectors 16 to be tested for the presence of explosives, and then exhausting the air via the exhaust pipe 18. It should therefore be understood that the seating arrangement of the aircraft shown in FIG. 2 is exemplary only and that the invention herein is applicable to other arrangements. By way of example, many aircraft contain multiple aisles and different numbers of seats per row than shown. In such cases, it should be clear that the detectors 16 should be positioned such that substantially the entire interior environment of the passenger compartment or any selected portion thereof is tested for explosives.

Now referring to FIG. 4, one of the air fan and explosives detector assemblies is shown. The air fan 14 is a conventional multispeed fan which draws air into the explosives detector 16. The explosives detector 16 tests the air for the presence of explosives and then exhausts the air via the exhaust pipe 18. The explosives detector 16 is a commercially available detector such as the Model 97 explosives detector manufactured by ITI Security of Burlington, Mass. This explosives detector detects explosives by sensing for the presence of gases which are emitted from explosives such as dynamite, TNT, C-4, PETN, and RDX. The air to be tested is drawn into the detector through a membrane which isolates the gas emitted by the explosives from the ambient air. This explosive gas is mixed with Argon and then fed to two passageways, one of which is coated with a material that selectively retards the progress of the gas from the explosives. Each of the two air passageways terminates in an electron capture detector. As the gas mixtures pass through the electron capture detectors, the gases are bombarded by beta particles from a sealed radioactive source to produce freed electrons which form an electric current within the explosives detector. If molecules from high explosives are present, they absorb the free electrons, thus reducing the current within the explosives detector. Thus, by sensing when the magnitude of the current falls below a predetermined threshold, the explosives detector is able to detect the presence of explosives.

The electronics of the explosives detection system are shown in FIG. 5. The heart of the electronics is a central processing unit ("CPU") 20 which is conventionally coupled to a read-only memory ("ROM") 22 and a random-access memory ("RAM") 24. The ROM 22 stores a computer program 26 which controls the operation of the CPU 20. The computer program 26 will be explained in detail below. The CPU 20 is also connected to a detector multiplexer 28 as well as a fan demultiplexer 30. The detector multiplexer 28 is coupled to a plurality of analog to digital ("A/D") converters 32, each of which is connected to the junction of a resistor 34 and an explosives detector 16. In order to determine whether a particular explosives detector 16 detects the presence of explosives, the CPU 20 activates the detector multiplexer 28 by sending the digitally encoded address of the desired explosives detector 16 via a line 36. The voltage produced at the junction of the resistor 34 and the desired detector 16 is sampled and converted to a digital representation by the A/D converter 32. This digital voltage is supplied to the multiplexer 28 which passes the digital signal to the CPU via a line 38. Thus, by sending various digitally encoded addresses to the detector multiplexer 28, each of the explosives detectors 16 in the system can be sampled.

The CPU 20 is also coupled to the fan demultiplexer 30 which is connected to each of the variable speed air fans 14 through a respective fan driver 40. The CPU 20 controls the operation of the air fans 14 by sending the digitally encoded address of the air fan 14 which the CPU desires to control to the fan demultiplexer 30 via a line 42. The CPU 20 then sends a fan speed control signal to the demultiplexer 30 via a line 44 which is supplied by the demultiplexer 30 to the appropriate fan driver 40. The fan driver 40 then supplies the appropriate signal to the fan 14 which drives the fan at the desired rate. The fan driver 40 is the latching type which "remembers" the signal supplied by the fan demultiplexer 30. Thus, the fan continues to operate at the speed last specified by the demultiplexer 30 until the fan driver 40 receives a different fan speed signal from the demultiplexer 30.

Of course, each of the explosives detectors 16 will have a respective A/D converter 32 and resistor 34, and each of the air fans 14 will have a respective fan driver 40. The number of air fans 14 and explosives detectors 16 required will depend on the number of rows of seats in the aircraft. Also, although only a single detector multiplexer 28 and a single fan demultiplexer 30 have been shown in FIG. 5, it is likely that a number of such multiplexers and demultiplexers will be required, depending on how many signal lines each of the devices 28, 30 can control.

The CPU 20 also provides a camera control output signal on a line 46 and an alarm indication output signal on a line 48. The alarm indication signal indicates that one of the explosives detectors 16 has detected the presence of explosives. The alarm signal, which is provided to a television monitor (not shown) in the cockpit of the aircraft, is used to alert the pilot that explosives are present on board the aircraft. The alarm signal causes the monitor to indicate the particular row in which explosives were sensed. In addition, the television monitor produces an image of the row in which explosives were detected, the image being provided by one of a pair of television cameras 50 so that the pilot can determine which passenger is likely to be the terrorist and take appropriate action. One of the cameras 50, each of which is conventionally positioned by a pair of stepping motors (not shown) driven by the camera control signal on the line 46 is directed towards the row in which a positive indication of the presence of explosives is made. Each of the cameras 50 is rotatable about its vertical axis, or side to side, and its horizontal axis, or up and down. These two directions of rotation allow the cameras 50 to be movable so that they can produce an image on the television monitor of each row of the aircraft. The positioning of the cameras 50 is accomplished with the use of a software table in the ROM 22 which includes both the horizontal and vertical axis coordinates of the camera position required for the cameras to view each row of seats in the aircraft. As the cameras are moved, the CPU 20 keeps track of the current horizontal and vertical axial position of the two cameras 50 as a number of steps from a starting, or "home," axial position. In order to move one of the cameras 50 to view a desired row, the CPU 20 retrieves the axial coordinates for the desired row from the software table in the ROM 22, computes the number of steps through which the stepping motors need to be driven based on current axial position of the camera 50, and drives the stepping motors the computed number of steps. The software table has predetermined axial position values which are conventionally determined and depend upon such factors as how many rows there are in the particular aircraft, the seat width and spacing, and the placement of the cameras with respect to the rows of seats. The cameras 50 are preferably assigned the rows which they will cover, for side of the aircraft and camera **50*b* covering the rows on example, camera 50*a*** covering the rows on the right-hand the left-hand side of the aircraft.

The alarm signal also causes all power to the aircraft to be shut off if the aircraft is on the ground and not moving. Of course, power to the aircraft engines must not be shut off when the airplane is still on the ground but in the process of taking off. In addition, the alarm signal may automatically cause a conventional transmitter (not shown) to transmit an emergency signal to the aircraft control tower.

Figure 6:
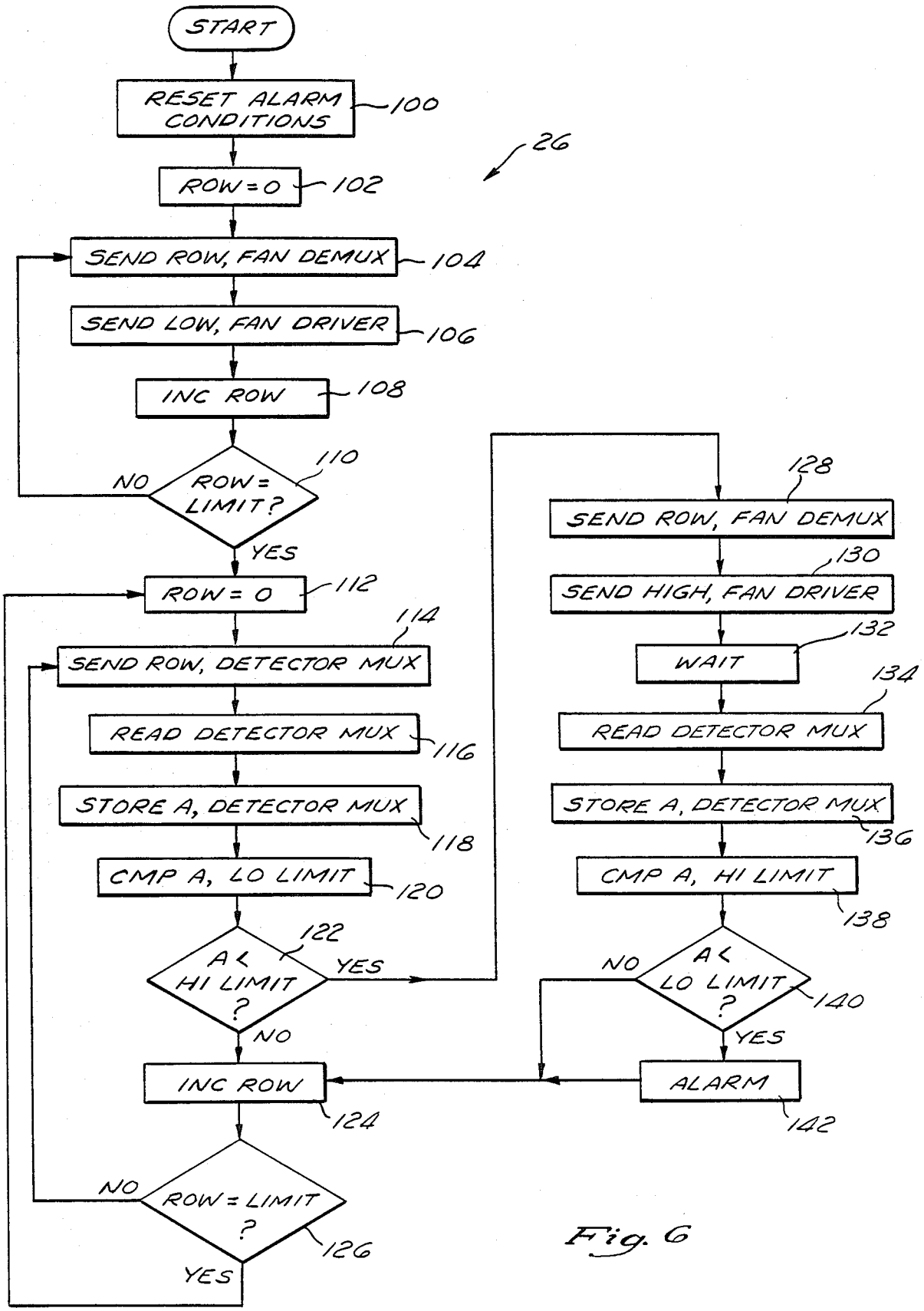
FIG. 6 is a flowchart of the operation of the electronics of FIG. 5.

A flowchart of the computer program 26 which controls the operation of the electronics is shown in FIG. 6. A first part of the computer program 26 resets the alarm conditions and turns on the air fans 14 prior to testing the interior passenger compartment of the aircraft for explosives. At step 100, the program resets the alarm conditions, forcing them to a non-alarm state to avoid an inadvertent alarm at power up. Steps 102–110 turn the air fan 14 in each row of the aircraft on to a low speed setting so that they draw air in from the passenger compartment and through the explosives detectors 16 to accelerate the detection process. At step 102, the variable ROW, which indicates the row number, is initialized to zero. At step 104, the row number ROW is sent to the fan demultiplexer 30 so that the demultiplexer 30 establishes an electrical path between the CPU 20 and the desired fan 14. At step 106, a LOW signal is sent to the fan driver 40 via the fan demultiplexer 30 so that the fan 14 in the desired row is turned on to a low speed setting. At step 108, the value of the variable ROW is incremented by one so that the fan 14 in the next row of the aircraft may be turned on. At step 110, the value of ROW is compared with the variable LIMIT, which represents a number equal to one less than the number of rows of seats in the aircraft. If the value of ROW equals the value of LIMIT, the fan 14 in each of the rows has been turned on, and the program continues to step 112. If the value of ROW is less than the value of LIMIT, there are more rows of seats for which the fans 14 need to be turned on. In this case, the program branches back to step 104 so that the fan 14 in the next row is turned on. Of course, the value of LIMIT will depend upon how many rows of seats the aircraft has in which the explosives detection system is incorporated. After step 110, each of the air fans 14 on board the aircraft is turned on and produces an air flow across each of the explosives detectors 16 to enhance their detection capability.

The next portion of the computer program 26 is the explosives sensing stage in which the output of each of the explosives detectors 16 is sampled on a multiplexed basis to determine whether any of the detectors 16 senses the presence of explosives. To this end, at step 112, the variable ROW is again set to zero so that the explosives sensing stage starts at the first row. At step 114, the value of the variable ROW is sent to the detector multiplexer 28 via line 36 so that an electrical path is established between the CPU 20 and the desired explosives detector 16. At step 116, the output of the desired explosives detector 16 is sampled, or "read," by the CPU 20 through the A/D converter 32 and the detector multiplexer 28. At step 118, the value of the output of the desired explosives detector 16 is stored at location A in the RAM 24. This stored value, which represents the voltage detected at the junction of the detector 16 and the resistor 34, is inversely proportional to the amount of explosives detected by the explosives detectors. As explained in connection with the description of the operation of one commercial embodiment of the explosives detector 16, gases emitted by explosives absorb freed electrons and reduce the electric current within the detector 16. As a result, the voltage at the junction of the detector 16 and resistor 34 is reduced. Thus, a small value stored in A indicates the presence of a large amount of explosives, while a larger value indicates a smaller amount or the absence of explosives. Of course, in most cases, no explosives will be present, and the value stored in A will be a relatively large number.

Next, at step 120, the value stored in A is compared to a first threshold value HILIMIT. The numeric value of HILIMIT is empirically determined so that it is substantially less than any numeric value read from the A/D converter 32 while air was being sampled in the absence of explosives. Thus, if the numeric value stored in A is less than HILIMIT, there is a strong likelihood that explosives are resent. In this case, the program branches to step 128 in order to confirm this preliminary indication of the presence of explosives, which will be explained in detail below in connection with steps 128–142. If the numeric value stored in A is greater than HILIMIT, no explosives are present in the row being sensed, and the program proceeds to step 124, which increments the value of ROW by one so that the next row can be tested for explosives. At step 126, the incremented value of ROW is compared with LIMIT, which has a numeric value that is one less than the number of rows in the aircraft. Thus, if ROW equals LIMIT, the sensing stage has just sampled the last row in the aircraft, and the program branches to step 112 to reset the value of ROW to zero so that sensing may begin again with the first row in the aircraft. As a result, each row in the aircraft is sampled on a round-robin basis, which for the purposes of this specification means that the first row is sampled first, each of the subsequent rows is sampled in order, and the rows are resampled upon the last row being sampled. Each row is also sampled on a multiplexed basis, which for the purposes of this specification means that not all of the rows are sampled simultaneously.

Now referring back to step 122, a value stored in A which is less than the value of HILIMIT is a preliminary indication of the presence of explosives which is subsequently confirmed in steps 128–140. This confirmation stage includes increasing the speed of the fan 14 in the row for which the preliminary positive indication was made and then sampling the output of the explosives detector 16 for this row again to see if its output is less than a second electronic threshold, LOLIMIT. To this end, at step 128 the fan demultiplexer 30, is sent the current value of ROW, which indicates the particular row being sampled. In this case, it is likely that explosives are present in this row since such a preliminary indication was made. Then at step 130, the CPU 20 sends a HIGH signal to the fan driver 40 to cause it to increase the speed of the fan 14 in the row to a higher level. Then, at step 132, the CPU 20 waits a sufficient period of time to allow the fan speed to increase and to allow time for the explosives' gases to travel at a faster rate of speed from their source to the explosives detector 16. At step 134, the output of the explosives detector is sampled for the second time by the CPU 20 by "reading" the value of the detector multiplexer 28. At step 136, this value is again stored in A, and then the value of A is compared to the second predetermined electronic threshold, LOLIMIT. If the value of A is less than the value of LOLIMIT, the preliminary indication of the presence of explosives is confirmed and the alarm signal is activated at step 142. If the value of A exceeds the value of LOLIMIT, the preliminary indication of the presence of explosives was spurious, and the program branches back to step 124 without activating the alarm signal so that the next row may be sensed for explosives.

The LOLIMIT threshold may be chosen so that it corresponds to a higher concentration of gases from explosives than that which corresponds to the HILIMIT threshold, taking into account the increased speed of the air fan 14. Alternatively, LOLIMIT may be chosen so that it corresponds to the same concentration of gases from explosives, taking fan speed into account, as that which corresponds to the HILIMIT.

In an alternative embodiment, the explosives detection system just described may include a conventional pressure transducer mounted adjacent each of the explosives detectors 16 to take into account pressure variations inside the passenger compartment of the aircraft which might affect the concentration of gases from explosives sensed by the detectors 16. In this embodiment, each of the pressure transducers is periodically sampled on a multiplexed basis by the CPU 20 in the same manner that the explosives detectors are sampled. The pressure transducers are coupled to a multiplexer connected to the CPU 20 which operates in a fashion similar to the detector multiplexer 28. The computer program 26 samples each pressure transducer just prior to sampling its associated explosives detector 16, and automatically adjusts the HILIMIT and LOLIMIT electronic thresholds up or down depending upon the pressure detected. In this manner, pressure variations are taken into account.

In another embodiment, the explosives detection system automatically increases the speed of the air fans 14 in the rows in front and in back of the row for which a positive preliminary indication of the presence of explosives has been made. Then, during the confirmation stage of the sensing stage, each of the detectors 16 in the three rows is sampled to determine whether explosives were present in any of the three rows.

In a further embodiment, each of the explosives detectors 16 has an additional air fan which causes air to be blown towards the detector. This second air fan for each detector may be mounted on the ceiling of the passenger compartment in order to blow air towards its associated detector. In this embodiment, the explosive detection system includes an additional fan driver 40 for each of the ceiling mounted fans, and the computer program activates each of the air fans 14 associated with each detector at the same time. Of course, in this embodiment, the second air fan associated with each detector could be placed at a different location than the ceiling.

In any of the embodiments of the explosives detection system described above, it would be advantageous to provide additional locations at which explosives detectors 16 are provided. For example, explosives detectors could be incorporated at the entrance to the aircraft as well as in the baggage compartment and at the aircraft doors leading to the baggage compartment. The explosives detectors could be located in the toilets as well as in the galley where the preparation of food takes place.

What is claimed is:

1. An explosives detection system for an aircraft comprising:

a plurality of explosives detectors located on an aircraft having a plurality of rows of seats to sample substantially the entire environment of the interior passenger compartment of the aircraft to detect the presence of explosives;

a plurality of fans positioned to cause air to be directed towards said explosives detectors; and an electronic circuit connected to said explosives detectors to provide a first electronic signal preliminarily indicating the presence of explosives on board the aircraft upon one of said explosives detectors sensing the presence of explosives, said first electronic signal causing the rotational speed of said fans to be increased to provide an increased air flow to said explosives detectors, said electronic circuit providing a second electronic signal confirming the presence of explosives on board the aircraft upon said one of said explosives detectors again sensing the presence of explosives.

2. An explosives detection system for an aircraft as defined in claim 1, wherein said first electronic signal is provided by said circuit upon said explosives detector sensing a concentration of explosives in the air that is higher than a first predetermined concentration and said second electronic signal is provided by said circuit upon said explosives detector sensing a concentration of explosives in the air that is higher than a second predetermined concentration.

3. An explosives detection system as defined in claim 2, wherein said second electronic signal causes all power to the aircraft to be shut off if the aircraft is on the ground and stationary.

4. An explosives detection system as defined in claim 3, wherein each of said rows of seats in the aircraft has one of said explosives detectors, each of said explosives detectors being located adjacent an end of one of said rows of seats.

5. An explosives detection system as defined in claim 3, wherein said explosives detectors are incorporated in the wall of the aircraft.

6. An explosives detection system as defined in claim 1, wherein the outputs of said explosives detectors are sampled by said electronic circuit on a multiplexed basis.

7. An explosives detection system as defined in claim 6, wherein said electronic circuit comprises:

a central processing unit;

at least one multiplexer connected between said central processing unit and said explosives detectors; and at least one demultiplexer connected between said central processing unit and said fans.

8. An explosives detection system for an aircraft, to detect passengers with explosives brought on board the aircraft, comprising:

a plurality of explosives detectors located on an aircraft having a plurality of rows of seats so that the environment of the interior passenger compartment of the aircraft is sampled in order to detect the presence of explosives brought on board the aircraft by a passenger, each of said plural detectors sampling the environment at locations proximate to one or more rows of seats to sense the presence of gases which are emitted from explosives to assist in identifying the passenger who has brought explosives on board the aircraft; and an electronic circuit connected to said explosives detectors, said electronic circuit providing an electronic signal indicating the presence of said explosives on board the aircraft upon one of said explosives detectors sensing the presence of said explosives when a predetermined level of explosive gases is detected by any of said detectors.

9. An explosives detection system as defined in claim 8, wherein said electronic signal causes all power to the aircraft to be shut off if the aircraft is on the ground and stationary.

10. An explosives detection system as defined in claim 9, wherein each of said rows of seats in the aircraft has one of said explosives, detectors, each of said explosives detectors being located adjacent an end of one of said rows of seats.

11. An explosives detection system as defined in claim 10, wherein said explosives detectors are incorporated in the wall of the aircraft.

12. An explosives detection system as defined in claim 8, additionally comprising a plurality of fans positioned to cause air to be directed towards said explosives detectors.

13. An explosives detection system for an aircraft, comprising:

a plurality of explosives detectors located on an aircraft having a plurality of rows of seats so that the environment of the interior passenger compartment of the aircraft is sampled in order to detect the presence of explosives;

an electronic circuit connected to said explosives detectors, said electronic circuit providing an electronic signal indicating the presence of explosives on board the aircraft upon one of said explosives detectors sensing the presence of said explosives;

a plurality of fans positioned to cause air to be directed towards said explosives detectors;

at least one camera responsive to said electronic circuit; and a monitor for displaying the image produced by said camera, said electronic signal causing said camera to be directed towards the row of seats corresponding to said one of said explosives detectors sensing the presence of explosives, whereby an image of the occupants of said rows of seats can be viewed on said monitor.

14. An explosives detection system for an aircraft, to detect passengers with explosives brought on board the aircraft, comprising:

a plurality of explosives detectors located on an aircraft having a plurality of rows of seats so that the environment of the interior passenger compartment of the aircraft is sampled in order to detect the presence of explosives brought on board the aircraft by a passenger, each of said plurality detectors sampling the environment at locations proximate to one or more rows of seats to sense the presence of gases which are emitted from explosives to assist in identifying the passenger who has brought explosives on board the aircraft; and an electronic circuit connected to said explosives detectors, said electronic circuit providing an electronic signal indicating the presence of said explosives on board the aircraft upon one of said explosives detectors sensing the presence of said explosives when a predetermined level of explosive gases is detected by any of said detectors, the outputs of said explosives detectors being periodically sampled by said electronic circuit on a multiplexed basis.

15. An explosives detection system as defined in claim 14, wherein said electronic circuit comprises:

a central processing unit; and at least one multiplexer connected between said central processing unit and said explosives detectors.

16. An explosives detection system for an aircraft, to detect passengers with explosives brought on board the aircraft, comprising:

a plurality of explosives detectors located on an aircraft having a plurality of rows of seats to sample the environment of the interior passenger compartment of the aircraft to detect the presence of explosives brought on board the aircraft by a passenger, each of said plural detectors sampling the environment at locations proximate to one or more rows of seats to sense the presence of gases which are emitted from explosives to assist in identifying the passenger who has brought explosives on board the aircraft; and an electronic circuit connected to said explosives detectors to provide a first electronic signal indicating the presence of said explosives on board the aircraft upon the output of one of said explosives detectors satisfying a first predetermined threshold and a second electronic signal upon the output of said explosives detector satisfying a second predetermined threshold.

17. An explosives detection system as defined in claim 16, wherein said second predetermined threshold is indicative of higher concentration of said explosives in the air being samples by said explosives detector.

18. An explosives detection system as defined in claim 17, wherein the output of said explosives detector is sampled twice, said output being sampled a first time to determine whether it surpasses said first threshold and said output being sampled a second time to determine whether it surpasses said second threshold only if said output surpasses said first threshold when sampled said first time.

19. An explosives detection system as defined in claim 8, further comprising:

a camera responsive to said electronic circuit;

said electronic signal causing said camera to be directed towards the portion of the passenger compartment corresponding to said one of said explosives detectors sensing the presence of explosives.

20. An explosives detection system as defined in claim 19, wherein said electronic signal causes all power to the aircraft to be shut off if the aircraft is on the ground and stationary.

21. An explosives detection system as defined in claim 19, further comprising an air circulation system which causes air from the passenger compartment to be directed towards said explosives detectors.

22. An explosives detection system as defined in claim 19, further comprising a monitor for displaying the image produced by said camera, whereby an image of the occupants of said portion of the passenger compartment can be viewed on said monitor.

* * * * *